United States Patent [19]

Bocharov et al.

[11] 4,069,700

[45] Jan. 24, 1978

[54] SCREW PRESS

[76] Inventors: Jury Alexandrovich Bocharov, ulitsa 15 Parkovayo 18, Korpus 1, kv. 109; Anatoly Vasilievich Safonov, Sevastopolsky prospekt 51, kv.11, both of Moscow; Anatoly Sergeevich Grigorenko, ulitsa Tovstukho 1, kv. 21, Omsk; Jury Antonovich Moroz, ulitsa Fugenfirova 11, kv. 91, Omsk; German Nikolaevich Kuznetsov, ulitsa Romanenko 8, kv. 46, Omsk, all of U.S.S.R.; Anatoly Ivanovich Zimin, deceased, late of Moscow, U.S.S.R., by Zimina, administratrix; Elizaveta Konstantinovna

[21] Appl. No.: 738,069

[22] Filed: Nov. 2, 1976

[51] Int. Cl.[2] ..... B21J 9/18

[52] U.S. Cl. ..... 72/407; 72/454

[58] Field of Search ..... 72/454, 407; 100/264, 100/290, 270, 289

[56] References Cited

U.S. PATENT DOCUMENTS

| | | | |
|---|---|---|---|
| 3,507,143 | 4/1970 | Georg | 100/270 |
| 3,512,476 | 5/1970 | Georg | 100/270 |
| 3,595,163 | 7/1971 | Baumann | 100/270 |

FOREIGN PATENT DOCUMENTS

| | | | |
|---|---|---|---|
| 1,396,765 | 3/1965 | France | 72/454 |

*Primary Examiner*—C.W. Lanham
*Assistant Examiner*—Gene P. Crosby
*Attorney, Agent, or Firm*—Fleit & Jacobson

[57] ABSTRACT

A screw press wherein slides carrying stamping tools are arranged on the frame coaxially with one another for reciprocation in opposite directions and connected to nuts cooperating with motion screws mounted on the frame, provided with flywheels and having right-hand and left-hand threads. A stamping die is arranged on the frame between the slides in such a manner that the splitting plane thereof is aligned with the stamping axis, one die is fixed to the frame and the other die is secured to a slide which is mounted in guides extending in the frame perpendicularly to the stamping axis, and there is provided a mechanism for clamping the dies during stamping. The motion screws are mounted in the frame for axial reciprocation during stamping. The press according to the invention is preferably used for stamping blanks of parts having asymmetrical distribution of metal mass lengthwise of the blank, such as turbine blades, compressor vanes and the like.

3 Claims, 6 Drawing Figures

SCREW PRESS

The invention relates to metal forming, and more specifically to screw presses.

The screw press according to the invention may most advantageously be used for stamping blanks of turbine blades, compressor vanes and similar parts, and where it is required to effect forming with asymmetrical distribution of metal mass lengthwise of the blank (drag links, socket wrench blanks, stepped shafts, gear blocks, and the like).

Known in the art are screw presses having slides carrying stamping tools which are coaxially arranged on the frame.

The slides are adapted to reciprocate in opposite directions, for which purpose each slide is connected to a piston rod of an individual actuating cylinder.

Two nuts are secured to each slide for cooperation with respective motion screws.

The motion screws are journalled in bearings in the frame and are provided with right-hand and left-hand threads at the ends.

Each motion screw has a flywheel for storing the kinetic energy.

One of the slides is mounted on one end of each motion screw and the other is mounted on the opposite ends of the motion screws.

The above-described screw presses may be used only for open-die stamping of parts with simple configuration.

At present, blanks for making parts with asymmetrical distribution of metal mass lengthwise of the blank, such as turbine blades, compressor vanes, drag links and other parts having two heads, are manufactured by heading on horizontal forging presses separating for each end, that is in several passes. Blanks of gear blocks, stepped shafts, socket wrenches and other similar parts are made by open-die hot stamping on hammers and hot-stamping crank presses.

The manufacture of such blanks is labour consuming and features a comparatively low metal utilization factor because large allowances for machining are required. Moreover in open-die stamping, additional metal is lost for fins, while the presence of fins requires an additional fin-removing operation.

It is an object of the invention to provide a screw press having a construction which enables sinble-stage stamping of parts having asymmetrical distribution of metal mass length wise of the blank.

Another object of the invention is to reduce per-part metal consumption.

A further object of the invention is to improve the quality of stamped blanks.

Still another object of the invention is to improve the accuracy of stamping.

Finally, it is an object of the invention to reduce labour consumption in stamping and machining.

The above objects are accomplished by that in a screw press wherein slides carrying stamping tools are arranged in a frame coaxially with one another for reciprocation in opposite directions and connected to nuts cooperating with motion screws which are mounted on the frame, provided with flywheels and have right-hand and left-hand threads, according to the invention, a stamping die is arranged in the frame between the slides in such a manner that the splitting plane thereof is aligned with the stamping axis, one die is fixed to the frame and the other die is secured to a slide which is mounted in guides extending in the frame perpendicularly to the stamping axis, and there is provided a mechanism for clamping the dies during stamping, the motion screws being mounted in the frame and adapted for axial displacement under the action of a force developed during stamping.

The motion screws are preferably mounted in the frame by means of a carrier frame mounted in the frame guides extending in parallel with the stamping axis.

The screws being accommodated in the carrier frame enable synchronous displacement of the screws relative to the frame.

The mechanism for clamping dies preferably comprises two cooperating wedges, one of which is fixed to the frame and the other is connected to the slide carrying the die and is movable relative thereto in a direction transversal to the direction of movement of the slide.

This die clamping mechanism is the simplest in structure and enables displacement of the die and die clamping during stamping using a single drive.

The screw press according to the invention enables the manufacture of blanks of parts having an intricate shape by the hot stamping method in a closed die with one stroke and with a single heating.

The stamping is effected without fins and requires minimum allowances for machining.

The invention will now be described with reference to a specific embodiment thereof, illustrated in the accompanying drawings, in which.

Figure 1:
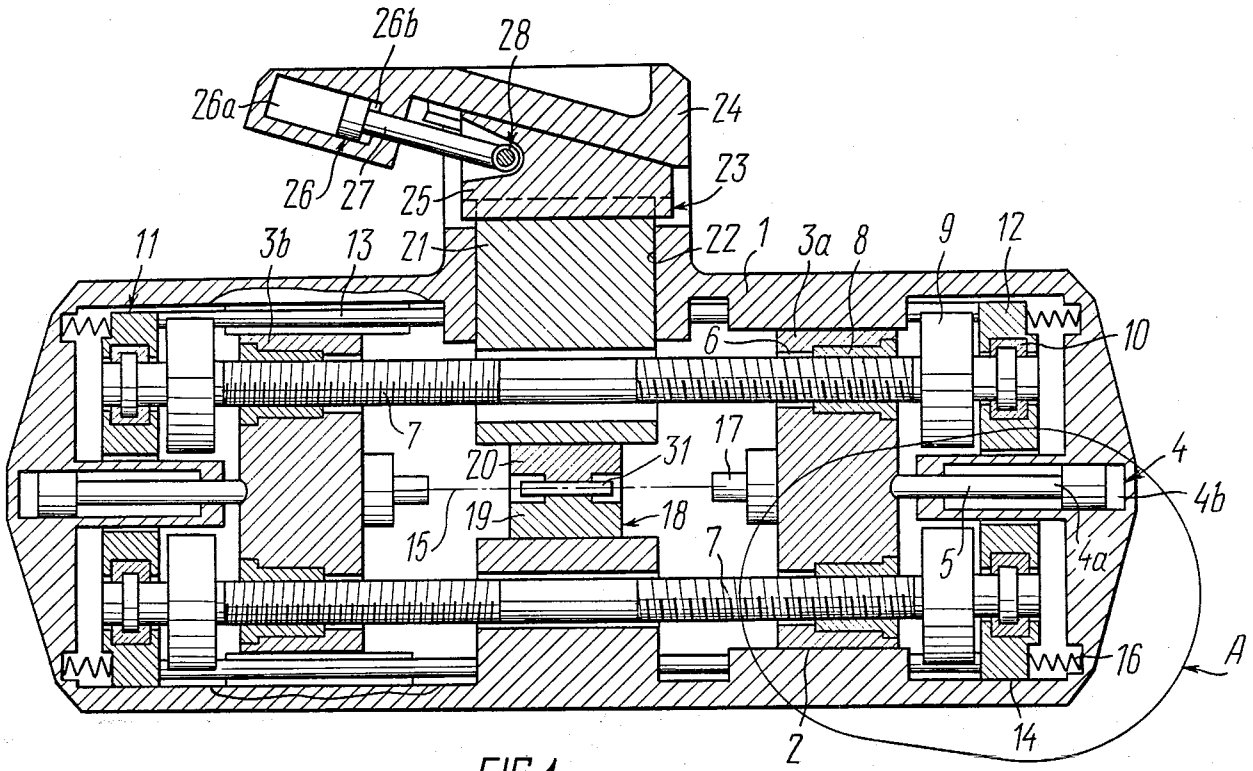
FIG. 1 is a longitudinal section view of a screw press according to the invention.

The screw press comprises a frame 1 having guides 2. Slides 3*a* and 3*b* are mounted coaxially with each other in the guides.

The slides 3*a* and 3*b* are identical in construction, therefore, whatever is true, in what follows, with reference to one of them is equally true for the other.

The slide 3*a* has an independent drive for reciprocation, and in this particular embodiment the drive comprises an actuating cylinder 4 having a piston rod 5 connected to the slide 3*a*.

The slide 3*a* has two parallel through holes 6 for screws 7.

The holes accommodate nuts 8 which are rigidly connected to the slide 3*a* and cooperate with the screws 7.

The screws 7 are provided, at the ends thereof, with right-hand and left-hand self-locking threads and have flywheels 9 for storing the kinetic energy.

The screws 7 are journalled in bearings 10 in a carrier frame 11 which is formed by traverses 12 and bars 13.

The carrier frame 11 is mounted in guides 14 of the frame 1 and is urged towards a geometrical stamping axis 15 by means of springs 16.

The carrier frame 11 is adapted to reciprocate in a direction along the axis 15 toward and away from a stamping die 18. The carrier frame is displaced in one direction under the action of a force developed during stamping, and is returned back to the initial position under the action of the springs 16.

Stamping tools comprising plungers 17 are secured to the slides 3*a* and 3*b*.

A stamping die 18 consisting of two dies 19 and 20 is arranged on the frame 1 between the slides 3*a* and 3*b* in such a manner that the splitting plane is aligned with the stamping axis 15.

The die 19 is rigidly fixed to the frame 1, and the die 20 is secured to a slide 21.

The slide 21 is mounted in guides 22 of the frame 1 which extend in a direction normal to the stamping axis 15.

At the opposite end of the slide 21, there is provided a mechanism 23 for clamping the dies 19, 20 during stamping.

The mechanism 23 comprises two cooperating wedges 24 and 25.

In this embodiment, the wedge 24 is made integral with the frame 1, and the wedge 25 is connected to the slide 21 by means of a dovetail joint so that the wedge 25 is movable relative to the slide 21 in a direction normal to the direction of movement of the slide 21.

The slide 21 is displaced by an actuating cylinder 26 having a piston rod 27 which is connected to the wedge 25 by means of an articulation joint 28 so that the actuating cylinder 26 moves the slide 21 and the wedge 25 for clamping the dies 19 and 20 during stamping.

Figure 2:
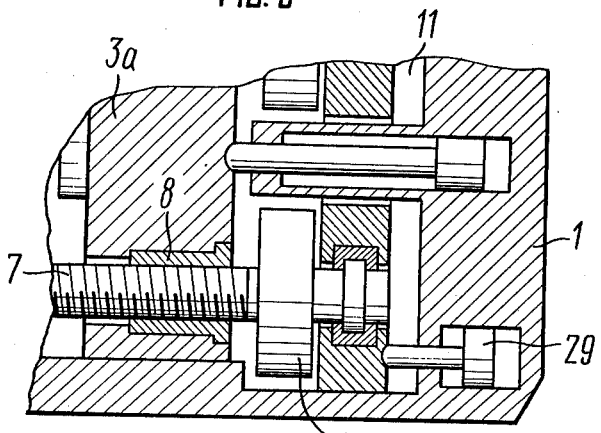
FIG. 2 shows detail A in FIG. 1 for an embodiment in which the carrier frame is returned back to the initial position by actuating cylinders.

In another embodiment, the carrier frame 11 is returned back to the initial position by means of actuating cylinders 29 (FIG. 2).

Figure 3:
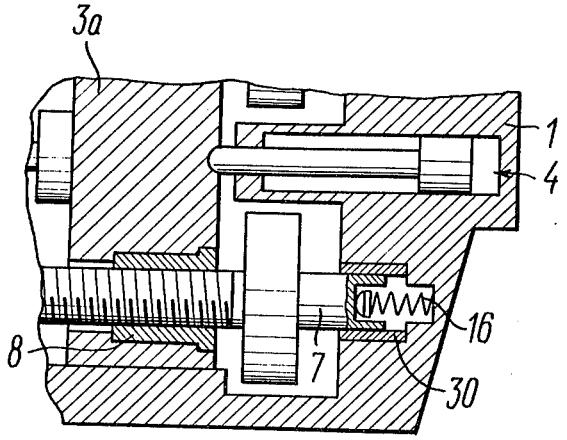
FIG. 3 shows detail A in FIG. 1 for an embodiment, in which each motion screw is mounted in the frame and adapted for independent axial displacement for returning back to the initial position.

Each motion screw 7 may be independently mounted in the frame. For this purpose, each motion screw 7 is mounted in the frame 1 by means of bearings 30 (FIG. 3) and is urged by means of springs 16 on either side for returning the motion screw to the initial position.

The screw press functions in the following manner.

The press is intended for stamping blanks of parts having asymmetrical metal mass distribution lengthwise of the blank. Since the amounts of deformation strokes on either side are different, a starting blank 31 is placed in the cavity of the lower die 19 asymmetrically, using a special reference mark or stop (not shown) which is then removed.

Then, the piston chamber 26*a* of the cylinder 26 is connected to a pressure source (not shown), and the piston rod chamber 26 *b* is connected to a discharge line.

Under the action of fluid pressure, the piston rod 27 moves the wedge 25, via the articulation joint 28, over the wedge 24. The slide 21 is displaced downwards (in the drawing) under the action of the wedge 25 in the guides 22.

At the end of the stroke, the stamping die 18 is closed, i.e. the die 20 closes the die 19 along the splitting plane.

Thus, the blank 31 is partially deformed (pressed-in) which it necessary for axial locking thereof so that it cannot be displaced axially during stamping.

The clamping mechanism 23 including the wedges 24 and 25 develops a force required for clamping the stamping die and the blank 31 under the action of the cylinder 26.

Subsequently, the piston rod chambers 4*a* of the cylinders 4 are connected to a discharge line, and the piston chambers 4*b* are connected to a pressure source (not shown).

Figure 4:
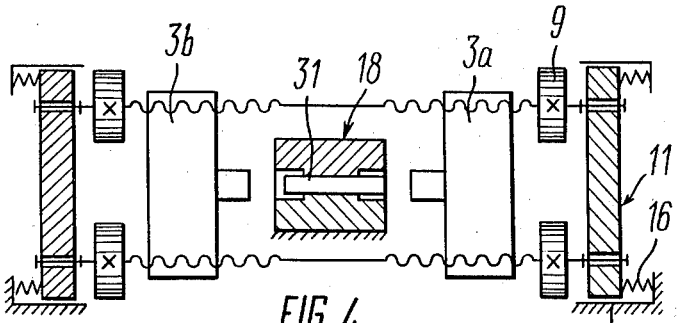
FIG. 4 shows the position of slides prior to an impact.

Under the action of fluid pressure, the piston rods 5 impart linear motion to the slides 3*a* and 3*b* (FIG. 4) in the guides 2 of the frame 1.

The slides 3 are displaced towards the middle of the press and the nuts 8 accommodated in the slides 3*a* and 3*b* cooperate with the screws 7 rotating them in the bearings 10 of the carrier frame 11.

The slides 3*a* and 3*b* move with acceleration under the action of a constant force applied by the cylinders 4, the flywheels 9 storing the kinetic energy necessary for stamping.

Figure 5:
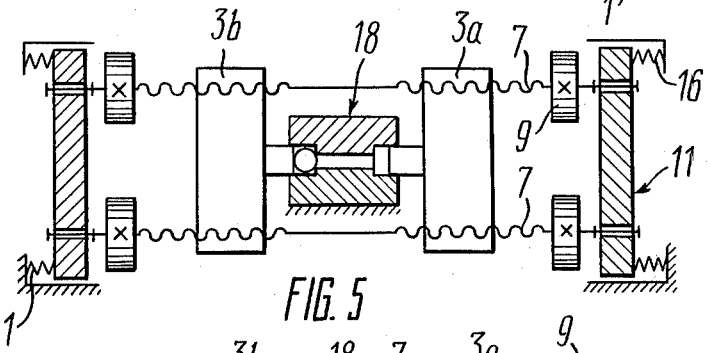
FIG. 5 shows the position of slides at the beginning of deformation of a blank.
Figure 6:
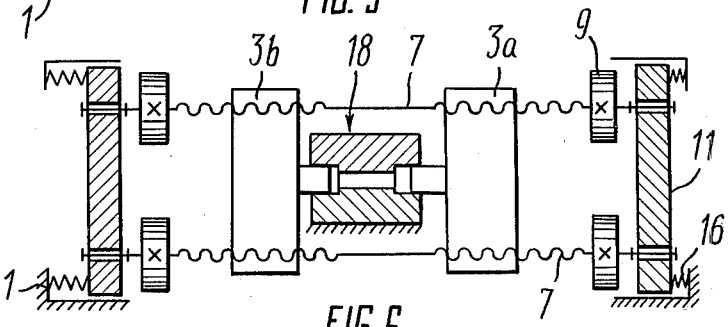
FIG. 6 shows the position of slides at the end of deformation of a blank.

During acceleration, the plungers 17 enter the stamping die 18, as shown in FIG. 5, to deform the blank 31. During stamping, the kinetic energy stored in the moving parts of the press is converted into the work of plastic deformation of the blank 31.

As a result of asymmetrical arrangement of the starting blank 31, the plunger 17 secured to the slide 3*a* comes in contact with the blank 31 earlier, the deformation of the blank begins, and the speed of the right-hand slide 3*a* drops.

When the speed of linear movement of the right-hand slide 3*a* decreases and the screws 7 still rotate due to the stored energy of the flywheels 9, there still exist relative rotational speeds of the nuts 8 and screws 7 so that the latter are displaced, together with the carrier frame 11 to the right (in the drawing) to compress the springs 16.

At the same time, the screws 7 and the flywheels 9 continue to rotate and impart accelerated movement to the left-hand slide 3*b* until the left-hand plunger 17 hits against the blank 31, and the axial displacement of the screws 7 to the right imparts an additional impulse to the slide 3*b*.

The forces at the plungers 17 of both slides 3*a* and 3*b* are equalized, and further stamping is performed with equal forces.

Upon completion of stamping the maximum forces at the right-hand slide 3*a* and left-hand slide 3*b* may be different.

In this case, the forces are equalized in the same manner

After the stamping operation is over, the return stroke of the slides 3*a* and 3*b* is effected. For that purpose, the piston chambers 4*b* of the cylinders 4 are connected to a discharge line, and the piston rod chambers 4*a* are connected to a pressure source. Under the action of liquid pressure, the piston rods impart linear motion to the slides 3*a* and 3*b* to return them back to the initial position.

Concurrently with the displacement of the slides 3*a* and 3*b*, the screws 7 with the carrier frame 11 are also returned back to the initial position under the action of the springs 16 (or actuating cylinders 29).

The stamping die 18 is open for removal of the stamped blank 31 upon lifting the slide 21.

For that purpose, the piston chamber 26*a* of the cylinder 26 is connected to a discharge line, and the piston rod chamber 26*b* is connected to a pressure source.

Under the action of liquid pressure transmitted via the piston rod and articulation joint 28, the wedge 25 is displaced along the wedge plane towards the cylinder 26.

The motion of the wedge 25 is transmitted to the slide 21 causing its movement in the guides 22 together with the die 20.

The stamping die 18 is open, and the finished blank is removed from the die 19.

What is claimed is:

1. A screw press comprising: a frame; slides mounted in the frame coaxially with one another for reciprocation in opposite directions; means for moving said slides along a stamping axis; nuts connected to said slides; motion screws mounted in said frame for cooperation with said nuts of the slides, said screws having right-hand and left-hand threads at the ends thereof, flywheels secured to said motion screws; said motion screws being mounted in said frame for axial movement under the action of a force developed during stamping; means for returning said motion screws back into an initial position; a stamping die consisting of two dies which is arranged in said frame between said slides in such a manner that a splitting plane thereof is aligned with the stamping axis; one die of said stamping die being fixed to the frame; guides of said frame extending perpendicularly to the stamping axis; a slide mounted in said guides; the other die of said stamping die being secured to said slide; a mechanism for clamping said dies during stamping; means for moving said slide with the other die of said stamping die.

2. A screw press according to claim 1, wherein the motion screws are mounted in the frame by means of a carrier frame mounted by frame guides extending in parallel with the stamping axis.

3. A screw press according to claim 1, wherein the mechanism for clamping said dies comprises two cooperating wedges, one of which is fixed to the frame and the other is connected to the slide carrying said other die, said other wedge being movable relative to the slide in a direction transversal to the direction of movement of the slide.

* * * * *